US010925413B2

(12) United States Patent
Doane

(10) Patent No.: US 10,925,413 B2
(45) Date of Patent: Feb. 23, 2021

(54) COLLAPSIBLE DISPLAY HUTCH WITH SHELVES

(71) Applicant: Kory Doane, Greeneville, TN (US)

(72) Inventor: Kory Doane, Greeneville, TN (US)

(73) Assignee: INTERSTATE SOUTHERN PACKAGING LLC, Greeneville, TN (US)

( * ) Notice: Subject to any disclaimer, the term of this patent is extended or adjusted under 35 U.S.C. 154(b) by 0 days.

(21) Appl. No.: 16/602,309

(22) Filed: Sep. 12, 2019

(65) Prior Publication Data

US 2020/0077816 A1 Mar. 12, 2020

Related U.S. Application Data

(60) Provisional application No. 62/730,380, filed on Sep. 12, 2018.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC ..... A47F 5/116; A47B 43/02
See application file for complete search history.

(56) References Cited

U.S. PATENT DOCUMENTS 3,628,842 A * 12/1971 Wright ..... A47B 43/02 312/259
4,630,740 A * 12/1986 Belokin, Jr. ..... A47F 5/116 211/194
4,854,246 A * 8/1989 Belokin ..... A47F 5/116 108/162
5,315,936 A * 5/1994 Smith ..... A47F 5/116 108/165
5,443,168 A * 8/1995 Dyment ..... A47F 5/116 211/149
6,612,669 B2 * 9/2003 Grueneberg ..... A47B 43/02 108/165
7,007,615 B2 * 3/2006 Grueneberg ..... A47B 43/02 108/165
8,485,370 B2 * 7/2013 Dewhurst ..... A47F 5/116 211/135
8,857,633 B2 * 10/2014 Dewhurst ..... A47F 5/116 211/135

(Continued)

FOREIGN PATENT DOCUMENTS

DE 102011116238 A1 * 4/2013 ..... A47F 5/116
DE 202014106151 U1 * 2/2015 ..... A47B 43/02

*Primary Examiner* — Stanton L Krycinski

(74) *Attorney, Agent, or Firm* — Arent Fox LLP; Michael Fainberg

(57) ABSTRACT

An easily erected, collapsible cardboard display for merchandise having a front panel, integral side panels and a rear panel integral with a side panel forming a housing into which a separate support panel is inserted to provide support. Shelves formed from the display's front panel are secured to the support panel and shelves formed from the support panel are secured to a rear panel to provide supported interior shelving. The housing side panels are integrally attached to the front panel and have longitudinal perforated fold lines formed down the middle dividing the side panel into equal sections allowing the display to be collapsed to a flat configuration.

16 Claims, 9 Drawing Sheets

(56) References Cited

U.S. PATENT DOCUMENTS

| | | | | |
|---|---|---|---|---|
| 9,211,021 | B2 * | 12/2015 | Smith | A47F 5/116 |
| 9,844,282 | B2 * | 12/2017 | Smith | A47F 5/116 |
| 9,907,414 | B2 * | 3/2018 | Heuer | A47B 43/00 |
| 9,949,579 | B1 * | 4/2018 | Frost | A47F 5/116 |
| 10,123,635 | B2 * | 11/2018 | Lilja | A47B 43/02 |
| 10,448,758 | B1 * | 10/2019 | Abel | A47B 43/02 |
| 10,463,176 | B1 * | 11/2019 | Sells | B65D 5/308 |
| 10,470,591 | B1 * | 11/2019 | Heiden | A47F 5/116 |
| 10,524,588 | B2 * | 1/2020 | Pratsch | A47B 43/02 |
| 10,531,750 | B1 * | 1/2020 | Heiden | A47F 5/0018 |
| 10,568,422 | B2 * | 2/2020 | Gibbons, Jr. | A47F 5/116 |
| 10,568,439 | B2 * | 2/2020 | Bersamin | A47F 5/116 |
| 2004/0148825 | A1 * | 8/2004 | Myers | A47F 5/116 40/124 |
| 2010/0006529 | A1 * | 1/2010 | Groff | A47F 5/116 211/186 |
| 2017/0238727 | A1 * | 8/2017 | Ertl | G09F 7/18 |
| 2017/0245661 | A1 * | 8/2017 | Heuer | A47B 96/021 |
| 2018/0289178 | A1 * | 10/2018 | McMillan-Sweat | A47F 5/116 |
| 2019/0014927 | A1 * | 1/2019 | Nixon | A47B 47/06 |

* cited by examiner

COLLAPSIBLE DISPLAY HUTCH WITH SHELVES

RELATED APPLICATIONS

This application claims priority and benefits from provisional patent application No. 62/730,380 filed Sep. 12, 2018.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

None.

FIELD OF THE INVENTION

The present invention relates to display devices, and more particularly, to a two piece cardboard foldable shelf hutch for supporting and displaying articles of merchandise such as cakes and grocery store items. The hutch can be collapsed into a compact flat assembly for shipping and transportation.

BACKGROUND OF THE INVENTION

Corrugated fiberboard (i.e., cardboard) is a well-known structural material commonly used for manufacturing storage boxes and the like. The low cost of the material, its structural qualities, and the ease with which it can be structured has resulted in an ever growing number of items manufactured from it. The use of corrugated fiberboard in merchandising displays is well known and range from its use as a structural component in an advertising message to various support structures for display of merchandise for sale in an aesthetically pleasing manner. In general, these merchandising displays are box-like structures with bins or shelves sized to hold the merchandise for sale. The displays can be quite bulky and difficult to transport in their assembled state and hence are generally shipped flat and assembled at the point of use. The displays often consist of multiple components and, as these displays become ever more sophisticated, the degree of expertise and training necessary to assemble them increases accordingly.

What is currently needed is a merchandising display that is intuitive to assemble, yet equally sturdy and aesthetically pleasing in use. Preferably, the device ships flat for easier transport and is then assembled on site when needed. More preferably, the device can also be easily disassembled and re-used. Any such display should be easy to manufacture and its design should entail a minimum of wasted material during manufacture.

Collapsible displays that may be used for merchandising are known in the prior art.

U.S. Pat. No. 4,493,424 issued Jan. 15, 1985 is a three shelf foldable display stand constructed from a single sheet of cardboard including shelves with raised front and side flanges to facilitate containing merchandise therein. The device is shipped unassembled and the free ends must be glued together by the customer in order to erect the device. In a separate step, individual die cut shelves pivot from the front panel of the device and are folded upwardly into individual attachment slots on the rear panel of the device.

U.S. Pat. No. 5,826,732 issued Oct. 27, 1998 is a point-of-purchase shelving display device constructed from a "single blank" of corrugated material that may be collapsed into a "substantially flat" configuration for efficient shipment. The device uses various "locking tab[s]" and "locking slot[s]" to lock the device into its three-dimensional configuration. Additionally, the flat shelves of the device are separate structures that are mounted into slots die cut in the superstructure of the display. Unlike the present inventive combination, this device entails the assembly of multiple, interconnected pieces and requires significant training and/or instructions for assembly.

U.S. Pat. No. 6,715,623 issued Apr. 6, 2004 discloses a collapsible display shelving unit fabricated from corrugated paperboard. The sides and multiple, flat shelves are hinged to the rear wall of the device thereby enabling the entire structure to be folded flat for convenient transport. The structures of the device are mounted only to the rear wall and are not in communication with one another. Assembly of the device entails a series of steps requiring the user to individually pivot the sidewalls outward, then swing individual shelves downward, thereafter locking them into place against the sidewalls.

Similarly, U.S. Pat. No. 8,485,370 issued Jul. 16, 2013 and U.S. Pat. No. 8,857,633 issued Oct. 14, 2014 are directed toward a shelving display system formed from a single blank of corrugated material. The '370 and '633 displays include two shelf panels, one panel having a plurality of shelves forming a first shelf component and a second panel having a plurality of shelves forming a second shelf component. Each shelf is formed of two components which are fastened together by a tab cut into the first component, which is inserted into a slot cut into the adjacent second component.

SUMMARY OF THE INVENTION

The present invention is a multi-shelved merchandising display made from two sheets of scored and cut corrugated cardboard or a similar lightweight paper board-like material. In its collapsed state, both the housing and insert support member are substantially flat thereby minimizing the space needed for storage and ensuring easier transport. The apparatus is erected by simply pressing the housing exposed, hinged side walls towards one another to open the interior chamber. The insert member is shipped inside the housing and opened as the hutch is erected. The display is held open via its interfitting parts and is stabilized by the housing base and the weight of the merchandise being displayed on its shelves.

The housing of the display device is die-cut from a single sheet of corrugated cardboard and folded to create front, rear, and side panels, as well as shelves. The interior insert support member is also die cut from a single sheet of corrugated cardboard with pre-cut shelf support structures. The interior insert support member has a rear panel defining foldable shelf support structure and adjacent integral side panels which are folded inward to extend into the housing adjacent the side walls of the housing. A top support structure of the support member is folded inward and supports the top shelf of the housing the same in place by tab apertures which receive the tabs of the top shelf of the housing. The use of an internal support member or assembly provides greater stability and strength to the individual shelves of the housing. In assembling the display, the user need only apply pressure to the side walls of the housing thereby erecting the housing and fold the respective foldable shelf supports of the support assembly and shelves of the housing over the support structures positioning the shelves in a generally horizontal position.

The shelves of the present invention are formed from the front panel of the display housing by folding them inward over a planar top surface of the support structures to create front apertures in the housing through which items displayed on the shelves may be viewed and accessed, thereby minimizing waste and the materials needed for manufacture.

The present invention is simple to manufacture, minimizes material waste, is intuitive to assemble, and otherwise solves the aforementioned problems noted in the prior art.

It is an object of the invention to provide an inexpensive cardboard display device which is sturdy in construction and capable of supporting the weight of the articles of merchandise being exhibited.

It is another object of this invention to provide an attractive display device for displaying articles of merchandise thereon.

It is yet another object of this invention to provide a box-like display device having display shelves to hold merchandise.

It is a further object of this invention to provide a display device with a substantially flat collapsed profile which is easily collapsed for transport and is reusable and can be stored and shipped efficiently and is easily assembled.

It is still another object of this invention to provide a merchandising display which does not require any particular degree of skill or training to assemble or disassemble.

The invention will be better understood and objects other than those set forth above will become apparent when consideration is given to the following detailed description thereof. Such description makes reference to the annexed drawings herein.

DETAILED DESCRIPTION OF THE INVENTION

While the invention is described in connection with certain preferred embodiments, it is not intended that the present invention be so limited. On the contrary, it is intended to cover all alternatives, modifications, and equivalent arrangements as may be included within the spirit and scope of the invention as defined by the appended claims.

This invention may be constructed from any board-like material that is amenable to precision cutting and is easily foldable. In preferred embodiments, the invention is manufactured from corrugated cardboard. The invention may also be constructed from fiberboard, pulpboard, or corrugated board.

The preferred embodiment of the apparatus and best mode is rendered in FIGS. 1 through 11. The elements described herein apply to the aforementioned preferred embodiment.

Figure 1:
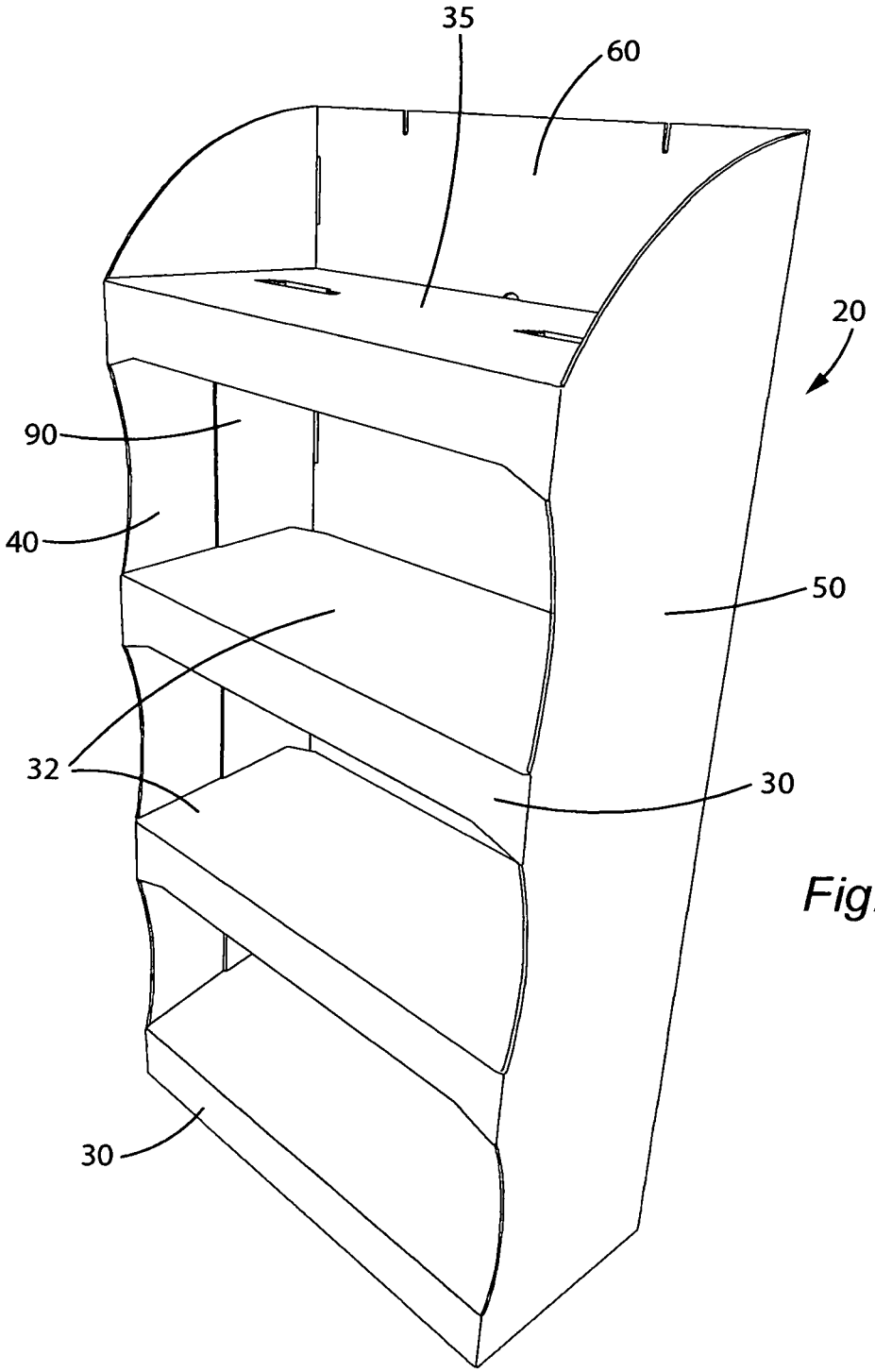
FIG. 1 is a perspective view of the inventive collapsible display hutch in erect assembled condition.
Figure 5:
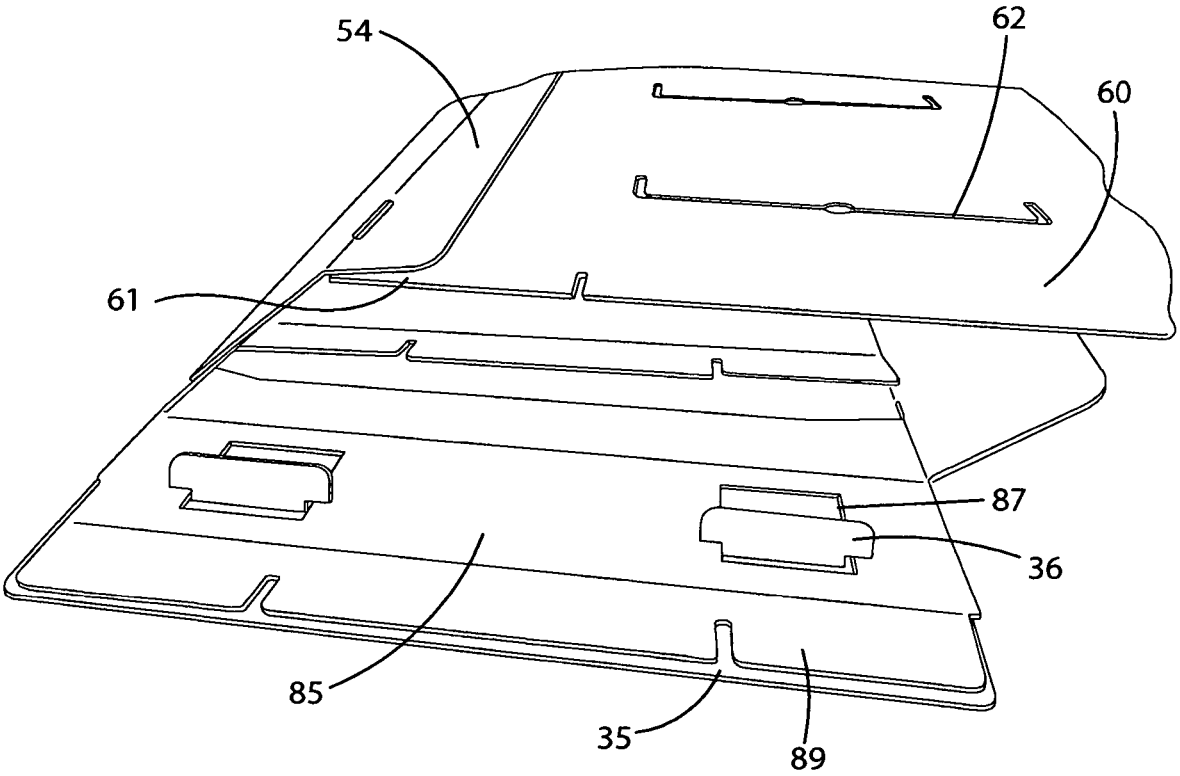
FIG. 5 is a partial perspective view of the collapsible display hutch shown in FIG. 1 in unassembled condition.
Figure 6:
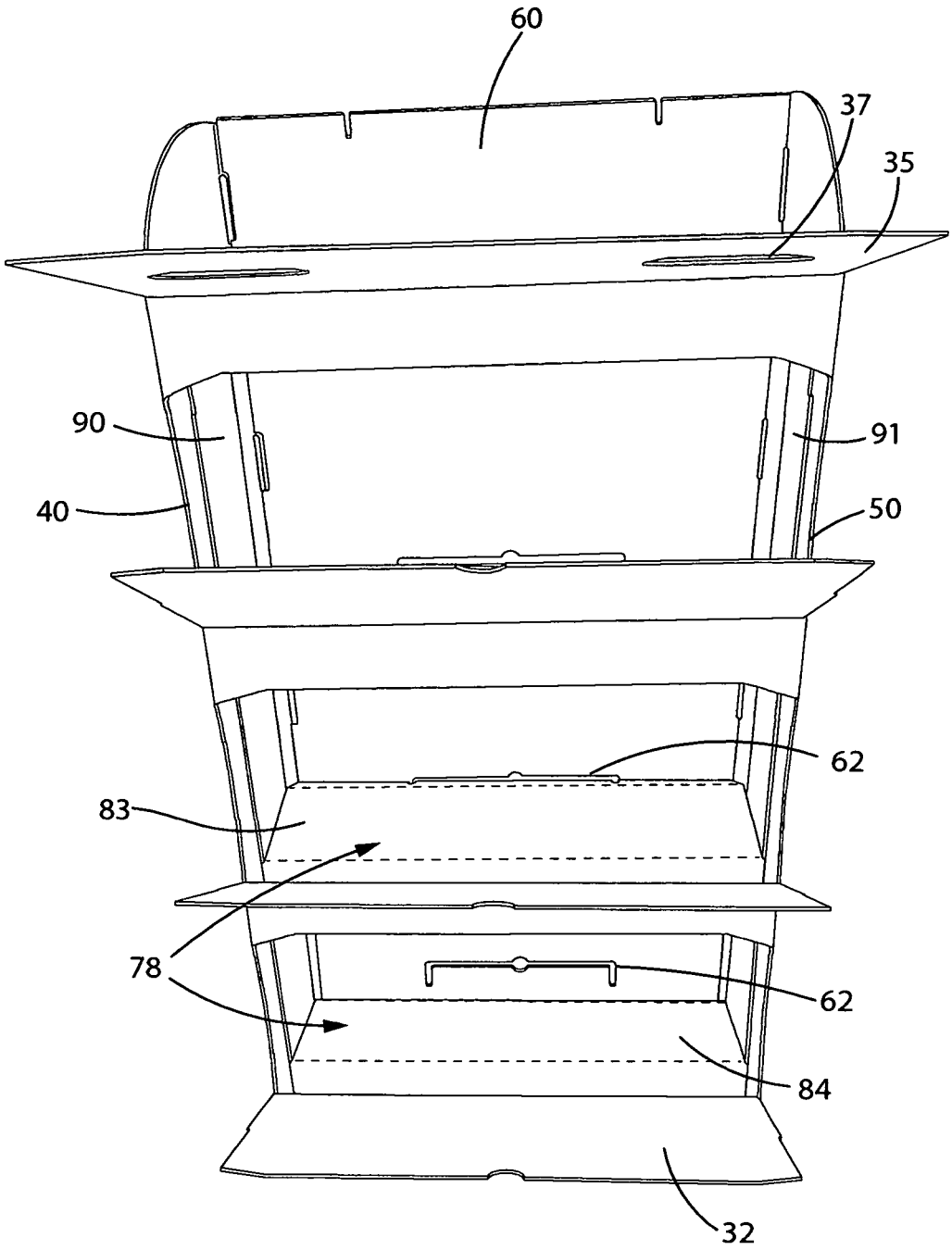
FIG. 6 is a front perspective view of the collapsible display hutch shown in FIG. 1 with the shelves unfolded in an outward position.

FIG. 1 is a perspective view of the preferred embodiment of the display hutch in which the display hutch 20 is depicted fully erect and ready for use. FIG. 5 is a partially collapsed view of the display hutch 20 and FIG. 6 is a front view of both the housing 22 (FIG. 2) and insert support assembly 24. (FIG. 3) The term cardboard as used in this description means cardboard, paperboard and corrugated paperboard and cardboard.

The present invention is directed to a collapsible shelving display hutch 20 constructed of a pre-scored and pre-cut outer cardboard housing 22. The blank 100 for same with excess material removed being shown in FIG. 2. The display hutch housing sheet as shown runs from 59½ inches high and 79 11/16 inches in length. Solid lines in the panels indicate cuts through the cardboard and dashed lines indicate score lines or fold lines. The display hutch housing 22 holds a pre-scored and pre-cut inner cardboard insert support 24, the blank 102 for same with excess material removed being shown in FIG. 3.

The housing 22 is formed from blank 100 and comprises a front panel 30 with an integral side panel 40, an opposite integral side panel 50 located on the opposite side of front panel 30, and a rear panel 60 integral to side panel 40. The rear panel 60 defines a plurality of vertically aligned horizontal inverted "U" shaped slots 62 cut through the panel and a base fold line 66 which is folded inward into the housing chamber when the housing is assembled to form a base for the display. The top of the rear panel 60 has an end cut line 65 which forms the top edge of the housing. This cut line 65 continues into side panel curved cut line 45 of side panel 40 to form curved side panels for the hutch display.

The front panel 30 defines a plurality of pre-cut and pre-scored shelves 32. Each shelf 32 is pre-cut for displacement away from front panel 30 and is provided with a fold line 34 allowing the shelf 32 to be folded inward into the interior chamber of housing 22 while being integrally connected to the front panel 30. Cutouts 38 are located opposite each other on shelves 32 allowing the shelves to be easily grasped and folded inward along the bottom fold line 34.

Figure 2:
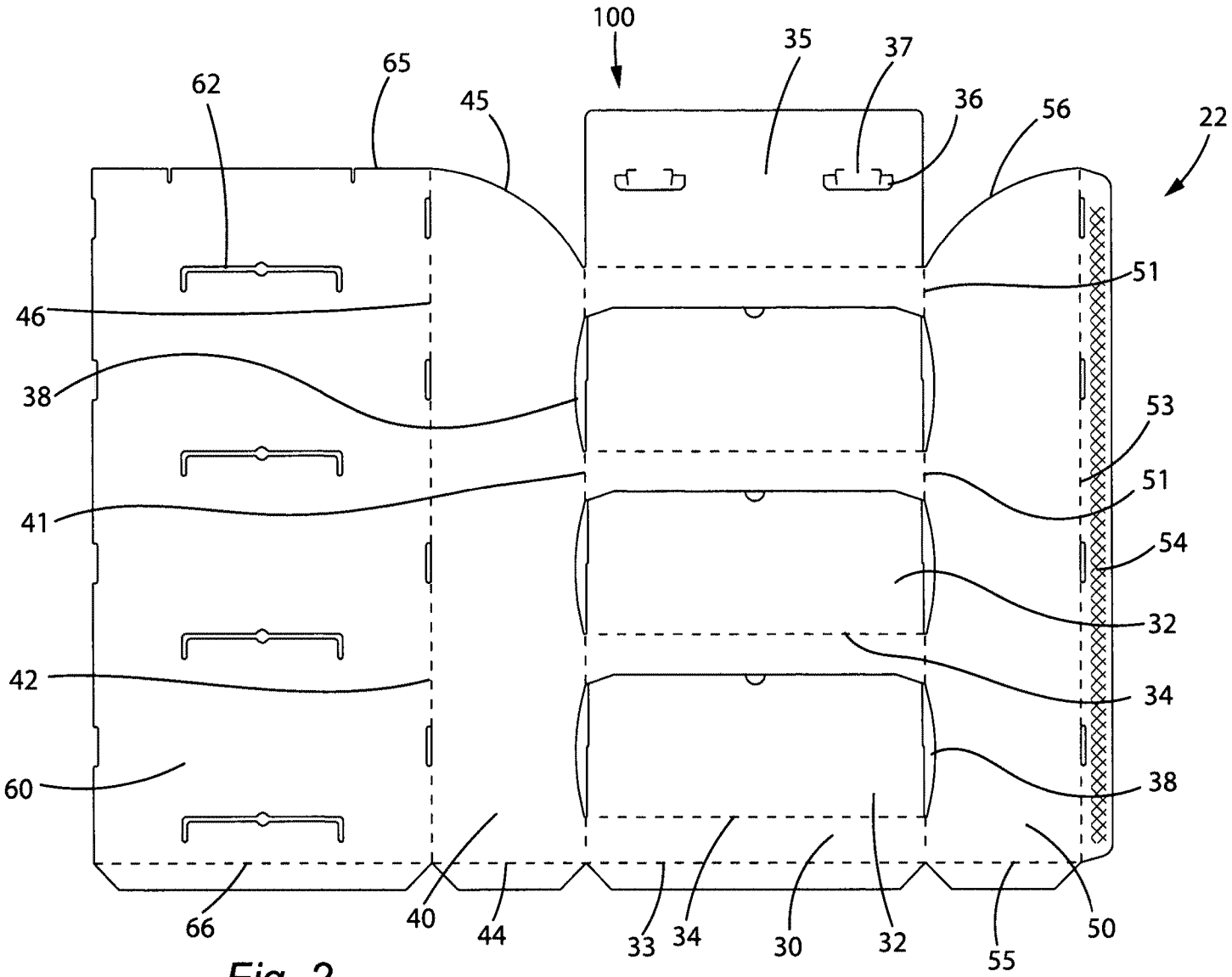
FIG. 2 is a plan view from a blank of corrugated material for constructing the front, side and rear exterior panels of the housing of the collapsible display hutch shown in FIG. 1.
Figure 4:
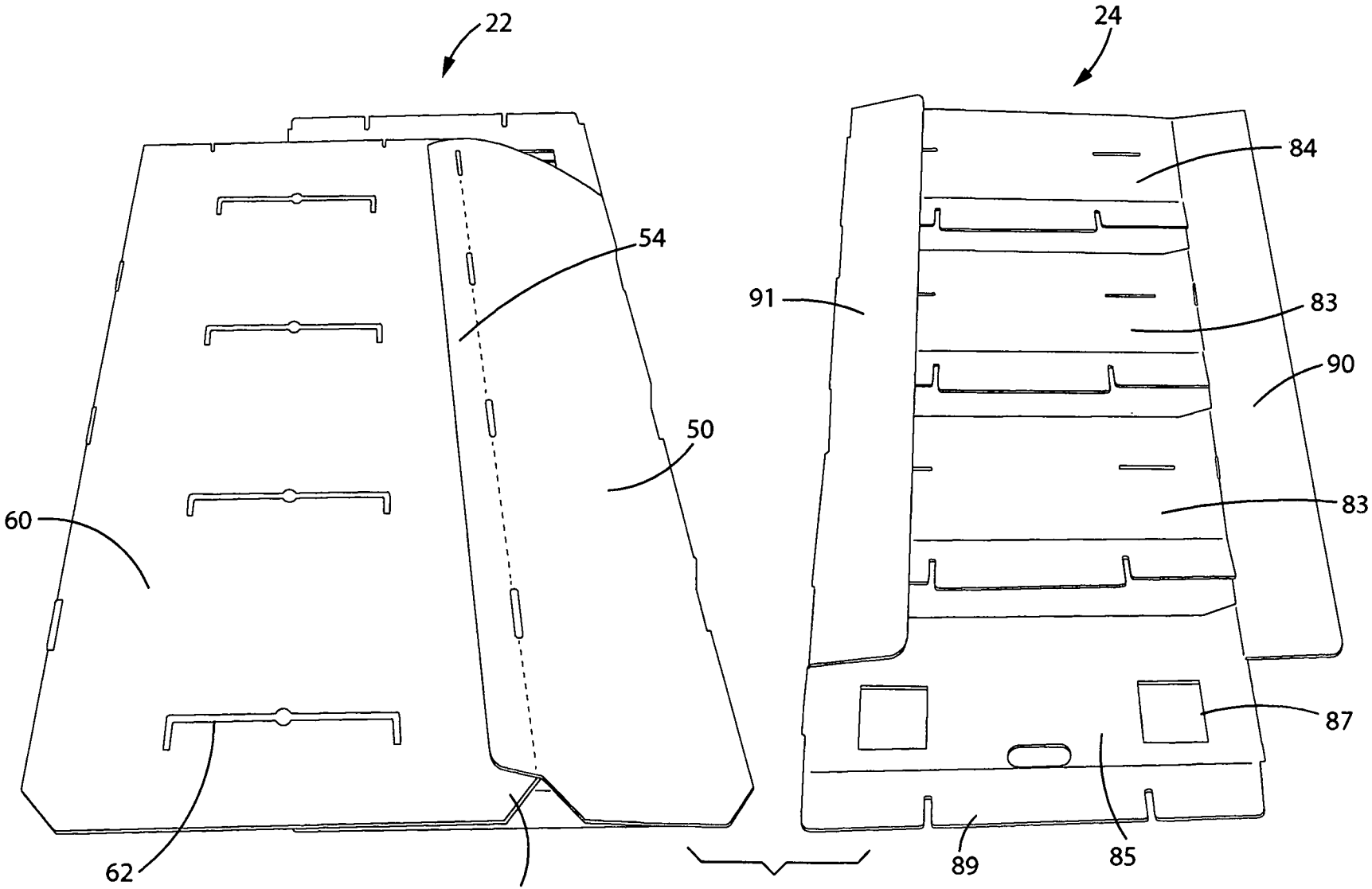
FIG. 4 is an exploded perspective view of the housing with the inner support assembly of the display hutch shown in FIG. 3 inverted and in a collapsed condition.

Side panel 50 is integrally attached to the front panel 30 and separated therefrom by fold line 51. Side panel 50 is also provided with an outer fold line 53 defining a glue edge tab 54 which allows the edge tab 54 to be folded perpendicular to the plane of side panel 50 so that it can be glued against the outer face 61 of rear panel 60 as shown in FIG. 4. The edge tab 54 orientation is more clearly shown in FIG. 4. The edge tab 54 is pre-glued before shipping which strengthens the housing and eliminates a gluing step in assembly of the hutch. As seen in FIG. 2 each shelf 32 is formed from a cut out 38 in the side panels 40 and 50 and a straight cut line on the front panel 30. The shelves are integrally connected to the front panel by a fold line 34. Dashed and perforated lines on the blanks shown in the Figures generally indicate fold lines where the respective portion of blank section is folded to create the assembly and solid lines create the cutout portion. Certain areas such as the glue edge tab 54 indicate the preferred areas for applying glue and are marked with straight line X's. However, glue can be applied as is necessary in any of the noted areas for specific applications. It should be noted that either hot or cold glue or a combination of same can be used.

The side panels 40 and 50 are integrally attached to the front panel 30 on opposite sides of the front panel along fold lines 41 and 51 and side panel 40 is integrally attached to rear panel 60 along fold line 42. Both side panels 40 and 50 define a curved cutout 45 and 56, respectively, above the top shelve 35 which form the top edge surface of each side panel.

Both side panels 40 and 50 have parallel perforated fold lines 41 and 51 intersected by cutouts 38 allowing the side panels to be folded inward parallel to each other away from the front panel 30 so that the front panel will have a flat profile. Rear panel 60 has an end cut 65 which runs along its upper edge leading into the upper curved cut 45 forming the top of side panel 40. The curved cut 45 ends at the bottom forward edge of the top front shelf 35 adjacent the shelf fold line so that the top of side panel 40 will present a curved appearance as is evident from the display 20 shown in FIG. 1. Rear panel 60 is folded perpendicular to side panel 40 along side panel fold line 42. The bottom fold line 66 of panel 60, the bottom fold line 44 of side panel 40, the bottom fold line 33 of front panel 30 and the bottom fold line 55 of the side panel 50 are folded inward to form an "L" shaped base support for all panels 60, 40, 30 and 50 which provides stability for the housing 22 and merchandise stacked on the housing.

Figure 8:
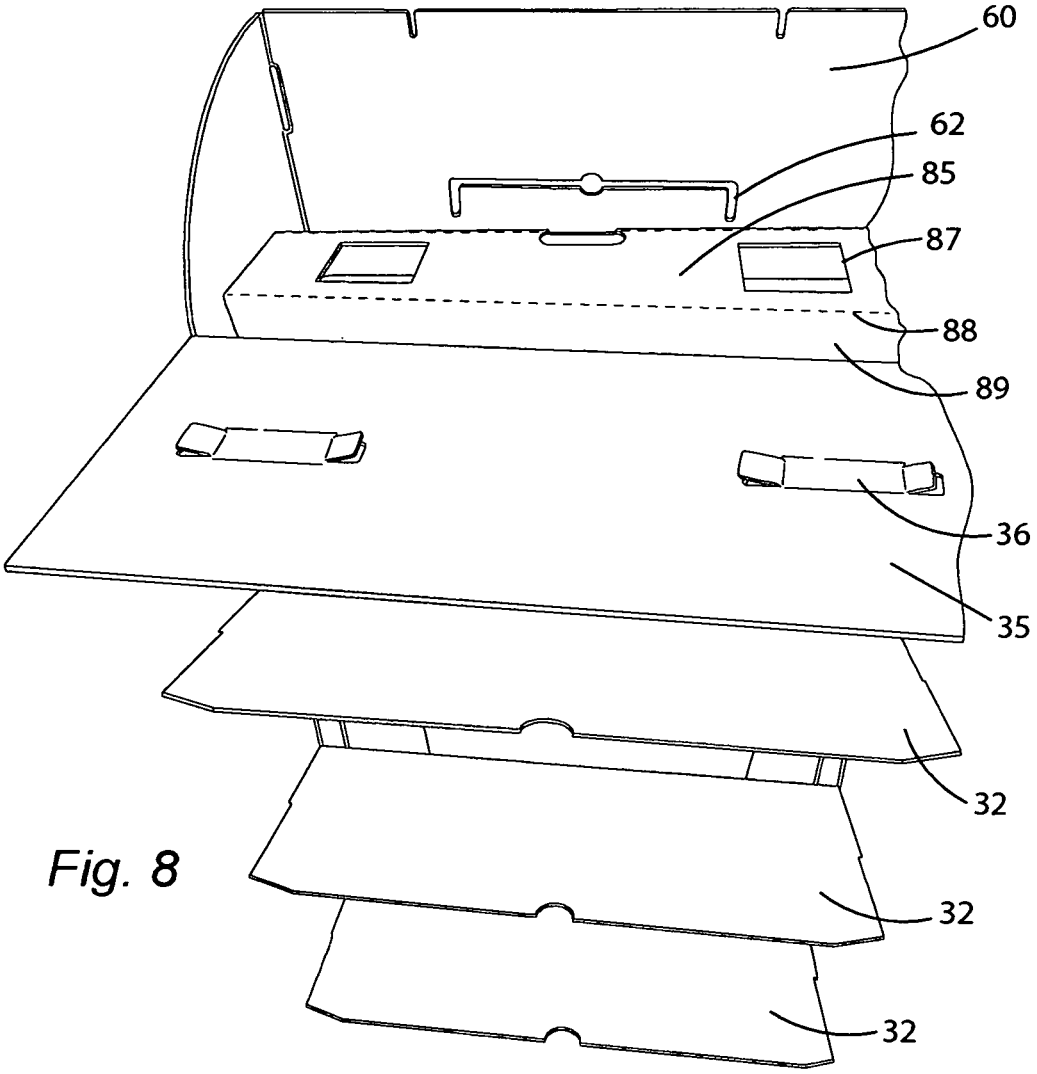
FIG. 8 is a partial perspective view of the top shelf tabs and top support structure before they are fastened together.
Figure 9:
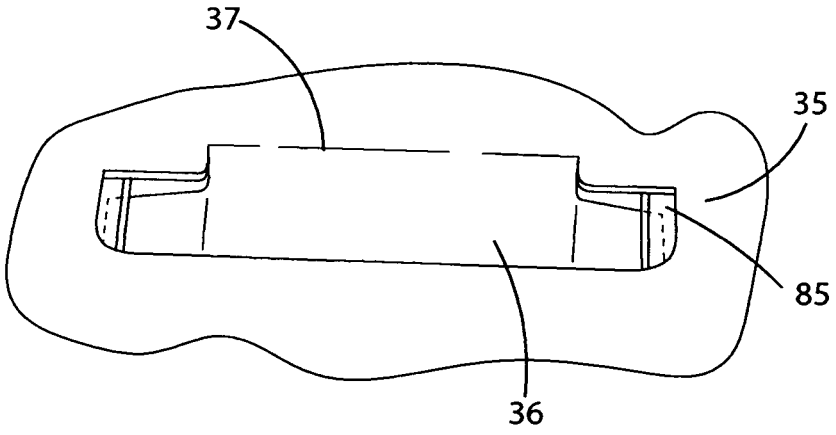
FIG. 9 is an enlarged view of the top shelf tabs mounted in the apertures of the top support structure.
Figure 11:
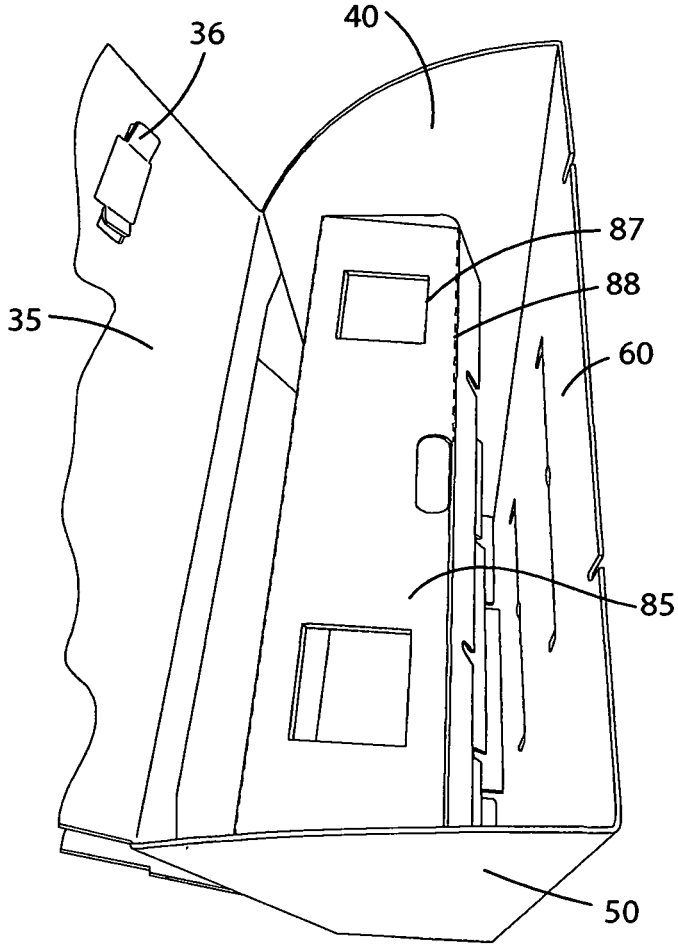
FIG. 11 is an enlarged top view of the inner support member before the top shelf has been fastened.

Two foldable tabs 36 (see FIGS. 2 and 9) of the top shelf 35 are partially cut out in shelf 35 allowing the tabs them to be folded downward along fold lines 37 and inserted through the rectangular apertures 87 cut into the top support member 85 of the insert support assembly 24 as seen in FIGS. 5, 8 and 11. The length along each tab 36 is greater than the width of the aperture 87 cut into top support structure 85.

The top shelf 35 is surrounded by side panels 40 and 50 and the rear panel 60 forming walls which preclude merchandise from being knocked out of the top tray or shelf 35. The planar support member surfaces 83, 84 and 85 and the shelves 32 and 35 form single supported shelves formed of the two stacked components (see FIGS. 1 and 3) when the assembly is assembled allowing the user to place articles on the respective shelf (32, 35). Shelves 32 and 35 are of greater width than support member planar surfaces 83, 84 and 85 as shown in FIGS. 1 and 6.

During erection and disassembly of the collapsible display apparatus 20, the insert support assembly 24 serves to position and provide support to the shelves as well as framing the shelves 60.

Figure 3:
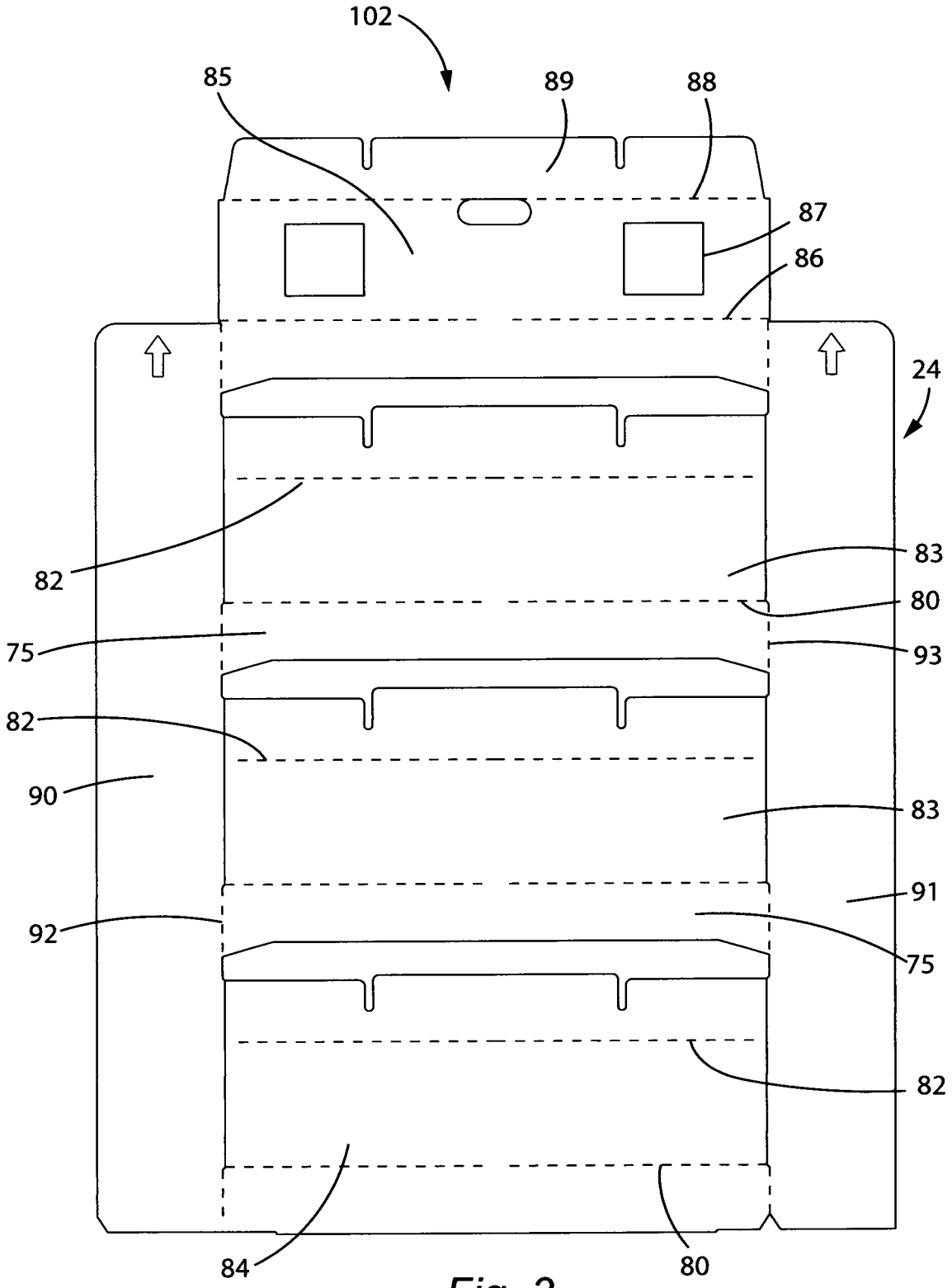
FIG. 3 is a plan view from a blank of corrugated material for constructing the inner support assembly of the invention as shown in FIG. 2.
Figure 7:
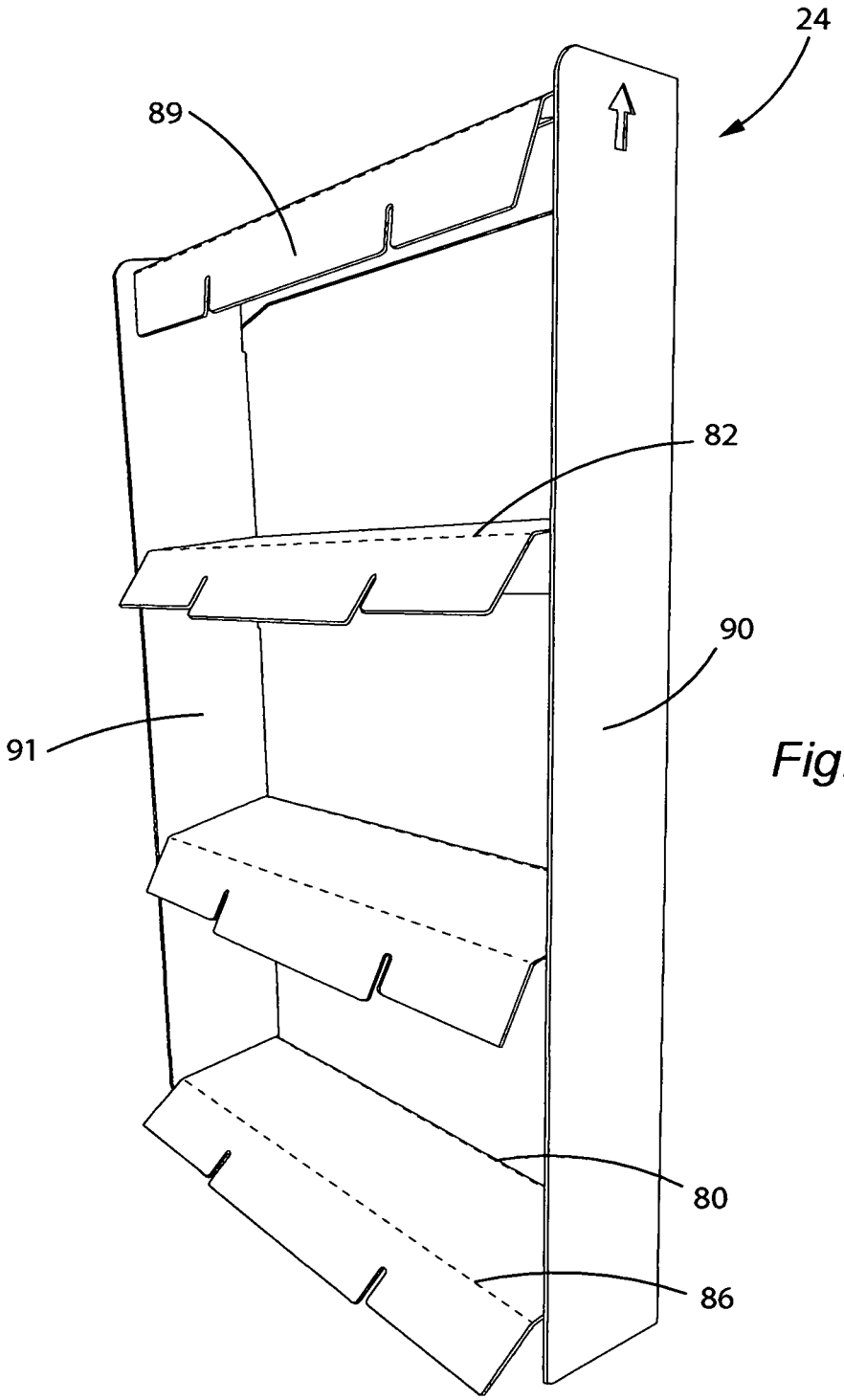
FIG. 7 is a rear perspective view of the inner support assembly.
Figure 10:
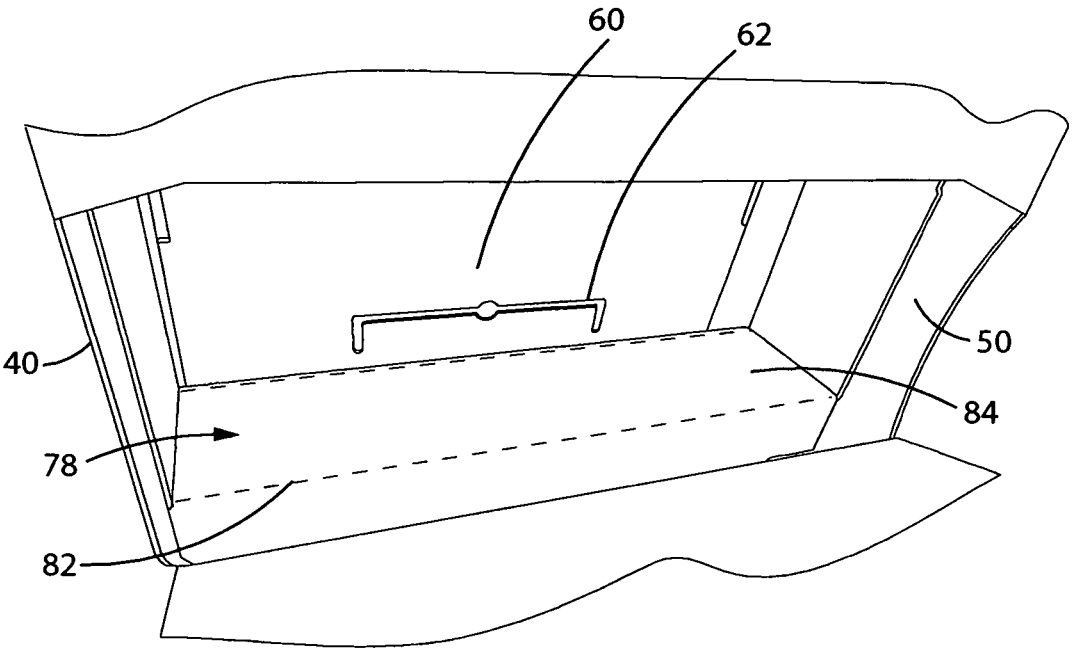
FIG. 10 is an enlarged partial perspective view of the bottom support section and bottom shelf before the associated shelf has been folded back over the bottom section.

FIG. 3 shows the material blank from which the collapsible insert support assembly 24 is constructed and FIG. 7 shows an upright version of the insert support assembly. The insert support assembly is preferably 53 7/16 inches in length or height and 37 15/16 inches in width. Solid lines in the panels indicate cuts through the cardboard and dashed lines indicate score lines or creases created. The front panel has integral side panels 90 and 91 which are separated from the front panel by fold lines 92 and 93, respectively. These side panels are folded inward and seated against the inner surface of the housing side panels 40 and 50 as seen in FIGS. 6 and 10. A plurality of shelf supports 75 are formed across the width of front panel as seen in FIG. 3. Each of the lower shelf supports is formed with a lower fold line 80 and a fold down line 82 which between them define shelf support section 83/84 which sits under and supports shelves 32 as seen in FIG. 1. The upper support section 85 has two horizontal fold lines 86, 88 and defines two square cutouts 87 which hold tabs 36 of the front panel shelf 35.

The display is manufactured and delivered substantially flat in its collapsed condition as seen in FIGS. 4 and 5 such that its front housing 22 is displaced substantially parallel relative to its insert support member 24 which inserted into housing 22.

In order to assemble the display device 20 from its collapsed configuration, one need only press the side panels 40 and 50 towards one another opening the housing.

FIGS. 2 and 3 show the die-cut blank material from which the present display device is constructed. In all the Figures, solid lines indicate cuts through the material and dashed or perforated lines indicate score lines or creases.

The display hutch 20 is assembled prior to shipping by placing glue on strip tab 54 at the location labeled "xxxx". The tab strip 54 is placed on the rear left corner of rear panel 60 of housing 22 and glued in place as shown in FIG. 4. Once the housing is opened, insert support member 24 is opened and held in place. The top flap 89 of the insert support member 24 is folded along fold line 88 and the top support section 85 is folded along fold line 86. The housing top shelf 35 is folded along fold line 34 down over the top support 85 and tabs 36 are folded down over fold line 37 and the extended tabs 36 are inserted into cutouts 87 and opened (see FIG. 9). The bottom shelf 32 is folded on fold line 34 inward into place so that the bottom shelf 32 is over the planar bottom support section 84. The two middle support sections 83 are the folded at fold line 82 and 80 back into the housing chamber and the shelves are folded into place.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A collapsible merchandising display comprising:

a display housing formed from a single blank of material configured in a generally rectilinear structure, said housing having at front panel, side panels mounted on opposite sides of said front panel integral to said front panel and a rear panel integral to one of said side panels, said front panel defining a plurality of foldable linearly aligned stacked shelves extending across the face of said front panel and a top shelf positioned over said stacked shelves, a distal edge of one side panel being integral to said rear panel and separated therefrom by a fold line, said other side panel forming a foldable glue strip with an inner fold line defining the area of the glue strip;

a separate insert support assembly positioned between said rear panel and said front panel of said housing; said insert support assembly being formed from single blank of material defining a rear panel with a plurality of foldable support members and a top foldable support member, all foldable support members extending from said rear panel and presenting a planar top surface and foldable side panels on each side of said rear panel, said insert support assembly side panels being of lesser width than said housing side panels and being positioned adjacent said housing side panels when the display is assembled; and said display assembly having a substantially flat configuration when collapsed and a rectangular configuration when assembled, wherein a top support is integral to the rear panel of the insert support assembly and is separated from the rear panel by a fold line, the top support defining a plurality of cutouts rectangular in configuration and defined to receive fastening means comprising foldable tabs, the foldable tabs are partially cut out in the top shelf to allow the foldable tabs to be folded downward along corresponding fold lines and inserted through the plurality of cutouts, and wherein the length along each foldable tab is greater than the width of the respective cutout.

2. A collapsible merchandising display as claimed in claim 1 wherein said merchandising display is manufactured from a material selected from a group of materials consisting of paper, cardboard, fiberboard, pulpboard, and corrugated board.

3. A collapsible merchandising display as claimed in claim 1 wherein each of said side panels of said display housing has a curved cut starting at the rear edge of said shelf and curving upward to an outer edge of the side panel.

4. A collapsible merchandising display as claimed in claim 1 wherein said side panel opposite said side panel integral to said rear panel has a tab fold line running parallel to a distal edge forming a glue fold tab, said glue fold tab being secured to an end of said rear panel of said housing.

5. A collapsible merchandising display as claimed in claim 1 wherein said side panels define a curved top cut adjacent said to shelf of said housing allowing visibility into said display assembly.

6. A collapsible merchandising display as claimed in claim 1 wherein said housing shelves have a greater width than said foldable support members of said support assembly.

7. A collapsible merchandising display as claimed in claim 1 wherein said housing rear panel defines a plurality of spaced slots cut therein.

8. A collapsible merchandising display as claimed in claim 1 wherein said front panel, side panels and rear panel of said display housing have a bottom foldable section which is folded away from each panel to form a seat for said cardboard merchandising display.

9. A collapsible cardboard merchandising display comprising:

a cardboard housing with a front panel, side panels integrally connected to said front panel and a rear panel integrally connected to one of said side panels, whereby a generally rectilinear housing is defined;

a cardboard support assembly disposed inside said housing between said rear panel and said front panel of said housing, said support assembly comprising a rear panel, support means mounted on said rear panel and integral side panels;

said cardboard support assembly support means comprising a plurality of support structures extending from said support assembly rear panel toward said housing front panel, each support structure comprising a foldable member with a top planar section;

a plurality of cardboard shelves mounted to said housing front panel, said shelves rearwardly extending from said housing front panel, with proximal end sections of said cardboard shelves being attached to said front panel;

at least one of said housing side panels being provided with a fold line running parallel to an outer edge forming a folded glue tab, said glue tab being adapted to be secured to said housing rear panel, wherein a top support is integral to the rear panel of the cardboard support assembly and is separated from the rear panel by a fold line, the top support defining a plurality of cutouts rectangular in configuration and defined to receive fastening means comprising foldable tabs, the foldable tabs are partially cut out in a housing top shelf to allow the foldable tabs to be folded downward along corresponding fold lines and inserted through the plurality of cutouts, and wherein the length along each foldable tab is greater than the width of the respective cutout.

10. A collapsible cardboard merchandising display as claimed in claim 9 wherein said merchandising display is manufactured from two separate blanks of cardboard.

11. A collapsible cardboard merchandising display as claimed in claim 9 wherein said cardboard housing is rectangular in an open assembled condition and has a flattened configuration in a collapsed configuration.

12. A collapsible merchandising display as claimed in claim 9 wherein said side panels of the support assembly are separated from said rear panel of the support assembly by fold lines.

13. A collapsible cardboard merchandising display foldable between an assembled configuration and an unassembled configuration comprising:

a unitary cardboard housing with a front panel, side panels integral to said front panel and a rear panel integral with one of said side panels defining a generally rectilinear housing when assembled;

a plurality of foldable cardboard shelves partially excised from said front panel of said housing but remaining attached along one side to said front panel;

a support assembly mounted within said housing comprising a rear panel and side panels integral with said rear panel and separated from said rear panel by fold lines; said rear panel being provided with a plurality of shelf supports which can be extended outward into said housing and which are excised from said support assembly rear panel but remain attached to said housing rear panel with said support assembly side panels being positioned adjacent to said housing side panels; and said housing front panel forming a set of aligned shelves when said cardboard display is opened from a collapsed state to an assembled configuration, said shelves being seated over said shelf supports of said support assembly rear panel, wherein a top support is integral to the rear panel of the support assembly and is separated from the rear panel by a fold line, the top support defining a plurality of cutouts rectangular in configuration and defined to receive fastening means comprising foldable tabs, the foldable tabs are partially cut out in a housing top shelf to allow the foldable tabs to be folded downward along corresponding fold lines and inserted through the plurality of cutouts, and wherein the length along each foldable tab is greater than the width of the respective cutout.

14. A collapsible cardboard merchandising display as claimed in claim 13 wherein said side panels of said housing have a curved cut end.

15. A collapsible merchandising display as claimed in claim 13 wherein said support assembly side panels have a shorter width than said housing side panels.

16. A collapsible cardboard merchandising display as claimed in claim 13 wherein said support assembly side panel are foldable and are seated adjacent said housing side panels when assembled.

* * * * *